US010864722B2

(12) United States Patent
Katoh et al.

(10) Patent No.: US 10,864,722 B2
(45) Date of Patent: Dec. 15, 2020

(54) LIQUID DISCHARGE APPARATUS

(71) Applicants: Ryuuta Katoh, Chiba (JP); Norimasa Sohgawa, Kanagawa (JP); Hiroki Takahashi, Kanagawa (JP)

(72) Inventors: Ryuuta Katoh, Chiba (JP); Norimasa Sohgawa, Kanagawa (JP); Hiroki Takahashi, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/355,763

(22) Filed: Mar. 17, 2019

(65) Prior Publication Data

US 2019/0283413 A1 Sep. 19, 2019

(30) Foreign Application Priority Data

Mar. 19, 2018 (JP) ..... 2018-050402

(51) Int. Cl.
*B41J 2/045* (2006.01)
*B41J 29/393* (2006.01)

(52) U.S. Cl.
CPC ..... *B41J 2/04588* (2013.01); *B41J 2/04508* (2013.01); *B41J 2/04581* (2013.01); *B41J 29/393* (2013.01); *B41J 2029/3935* (2013.01)

(58) Field of Classification Search
CPC .. B41J 2/04588; B41J 2/04508; B41J 29/393; B41J 2/04581; B41J 2029/3935; B41J 2/17509; B41J 29/38; B41J 2/04568; B41J 2/04593
See application file for complete search history.

(56) References Cited

U.S. PATENT DOCUMENTS

| | | | |
|---|---|---|---|
| 2016/0236466 A1 | 8/2016 | Takahashi et al. | |
| 2016/0355012 A1 | 12/2016 | Katoh et al. | |
| 2017/0066236 A1 | 3/2017 | Sohgawa et al. | |
| 2017/0165962 A1* | 6/2017 | Mizutani | B41J 29/393 |

FOREIGN PATENT DOCUMENTS

| | | |
|---|---|---|
| JP | 2016-150548 | 8/2016 |
| JP | 2016-221927 | 12/2016 |
| JP | 2017-001242 | 1/2017 |
| JP | 2017-109479 | 6/2017 |
| JP | 2017-132185 | 8/2017 |
| JP | 2017-164954 | 9/2017 |

OTHER PUBLICATIONS

IP.com search (Year: 2020).*

* cited by examiner

*Primary Examiner* — Lisa Solomon
(74) *Attorney, Agent, or Firm* — Oblon, McClelland, Maier & Neustadt, L.L.P.

(57) ABSTRACT

A liquid discharge apparatus includes a liquid discharge head and a pattern printer. The liquid discharge head includes a plurality of nozzles to discharge liquid. The pattern printer drives the liquid discharge head to print a plurality of adjacent rectangular patterns under different drive conditions. The adjacent rectangular patterns are a reference pattern and an adjustment pattern.

20 Claims, 9 Drawing Sheets

LIQUID DISCHARGE APPARATUS

CROSS-REFERENCE TO RELATED APPLICATION

This patent application is based on and claims priority pursuant to 35 U.S.C. § 119(a) to Japanese Patent Application No. 2018-050402, filed on Mar. 19, 2018, in the Japan Patent Office, the entire disclosure of which is hereby incorporated by reference herein.

BACKGROUND

Technical Field

The present disclosure relates to a liquid discharge apparatus.

Related Art

In an apparatus that uses a liquid discharge head, the discharge characteristics fluctuate depending on the number of nozzles being driven at the same time, and therefore, constant quality might not be achieved.

By a conventional technique, an adjustment pattern including a reference line printed with the reference number of nozzles and adjustment lines printed with an adjusted number of nozzles, and a reference pattern formed only with the reference line are printed, and a correction table is selected to correct the drive waveform so that the density of the reference pattern and the density of the adjustment pattern become the same.

SUMMARY

In an aspect of the present disclosure, there is provided a liquid discharge apparatus that includes a liquid discharge head and a pattern printer. The liquid discharge head includes a plurality of nozzles to discharge liquid. The pattern printer drives the liquid discharge head to print a plurality of adjacent rectangular patterns under different drive conditions. The adjacent rectangular patterns are a reference pattern and an adjustment pattern.

BRIEF DESCRIPTION OF THE DRAWINGS

A more complete appreciation of the disclosure and many of the attendant advantages and features thereof can be readily obtained and understood from the following detailed description with reference to the accompanying drawings, wherein.

Figure 1:
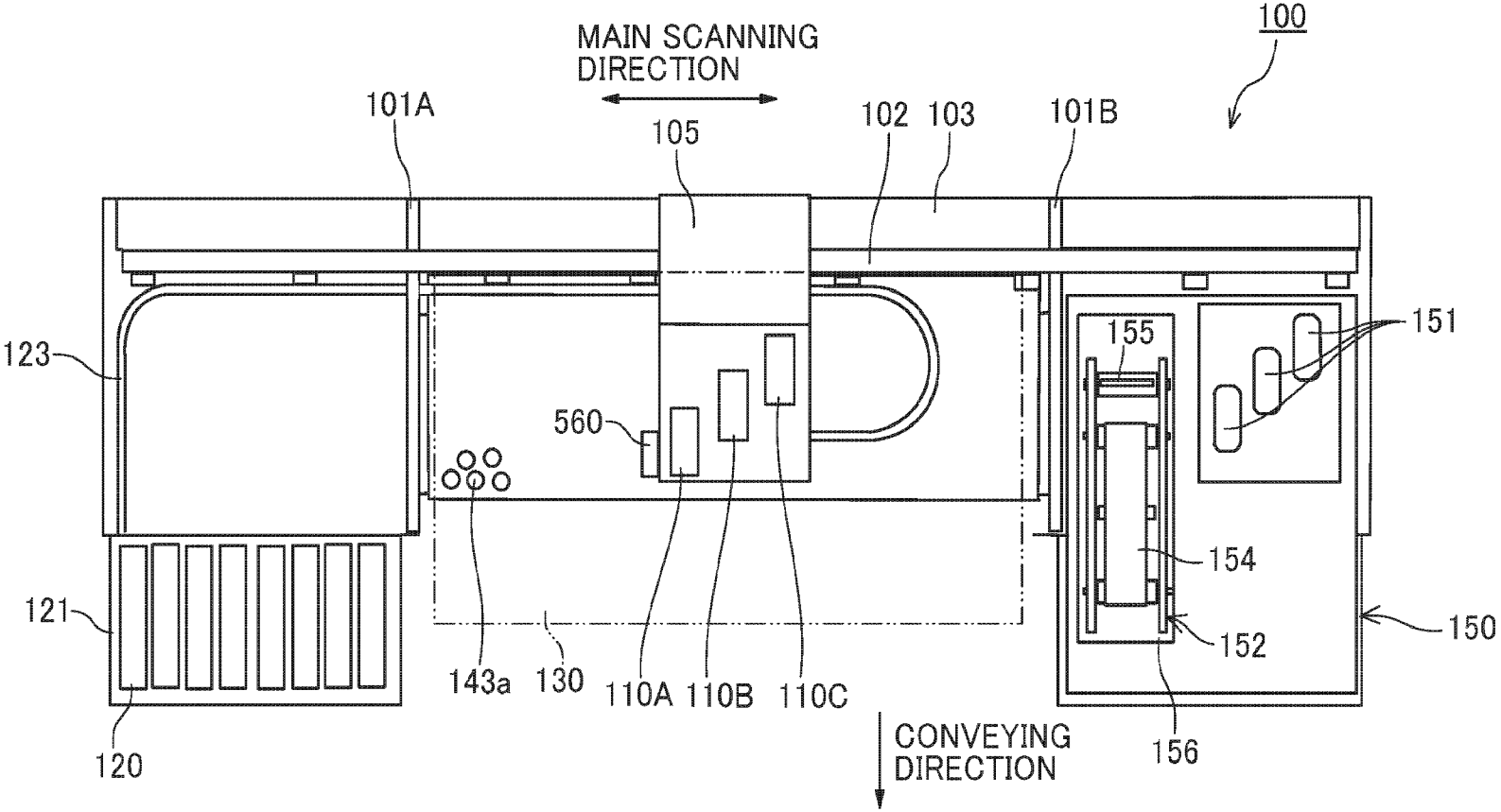
FIG. 1 is an explanatory plan view of the mechanism section of a liquid discharge apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

The terminology used herein is for the purpose of describing particular embodiments only and is not intended to be limiting of the present disclosure. As used herein, the singular forms "a", "an" and "the" are intended to include the plural forms as well, unless the context clearly indicates otherwise.

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

Figure 2:
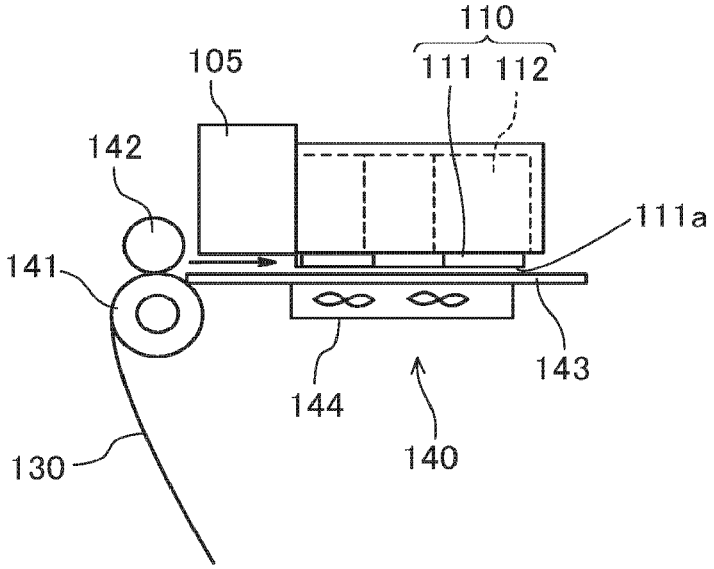
FIG. 2 is an explanatory side view of the principal components of the liquid discharge apparatus.

The following is a description of embodiments of the present disclosure, referring to the accompanying drawings. Referring first to FIGS. 1 and 2, an example of a liquid discharge apparatus according to an embodiment of the present disclosure is described. FIG. 1 is an explanatory plan view of a mechanism section of a printing apparatus as the liquid discharge apparatus. FIG. 2 is an explanatory side view of the principal components.

A printing apparatus 100 is a serial-type apparatus. A carriage 105 is held by guide mechanisms such as a principal guide member 102 and a subordinate guide plate 103 that bridge the space between right and left side plates 101A and 101B. The carriage 105 is movable in the main scanning direction.

Three liquid discharge units 110 (110A through 110C) are mounted on the carriage 105. Each liquid discharge unit 110 is formed by integrating a liquid discharge head (a head) 111 as a liquid discharge means and a sub tank 112 that supplies liquid to the head 111. The carriage 105 also includes a read sensor 560 that reads a rectangular pattern according to an embodiment of the present disclosure.

A cartridge holder 121 that holds a plurality of exchangeable main tanks (liquid cartridges) 120 containing liquids of respective colors is disposed in the apparatus main body. Liquids of respective colors are supplied by a liquid feed pump or the like, to the heads 111 of the respective liquid discharge units 110 from the main tanks 120 in the cartridge holder 121 via a liquid path 123 formed with supply tubes of the respective colors.

Meanwhile, to convey a sheet material 130 in the conveying direction, a conveying means 140 that attracts the sheet material 130 and conveys the sheet material 130 facing the head 111 is provided.

The conveying means 140 includes a conveying roller 141, a pressure roller 142 that is pressed against the conveying roller 141, a platen member 143 facing the head 111, and a suction mechanism unit 144 that attracts the sheet material 130 via suction holes 143*a* of the platen member 143. Although only some of the suction holes 143*a* are illustrated in the FIG. 1, the suction holes 143*a* are formed in the entire platen member 143.

A maintenance/recovery mechanism 150 that maintains/restores the head 111 is disposed on one side of the carriage 105 in the main scanning direction.

The maintenance/recovery mechanism 150 includes caps 151 for capping the nozzle faces 111*a* of the heads 111, and a wiping unit 152 including a web 154 for wiping the nozzle faces 111*a* and a wiper member 155. The wiping unit 152 is disposed on a main frame 156.

In the printing apparatus 100, the sheet material 130 is conveyed in the conveying direction by the conveying roller 141 and the pressure roller 142 while being attracted onto the platen member 143.

Therefore, the heads 111 are driven in accordance with a print signal while the carriage 105 is being moved in the main scanning direction, so that the liquids of required colors are discharged onto the sheet material 130 that is not moving, and one line is printed. After the sheet material 130 is conveyed a predetermined distance, printing of the next line is performed. This operation is repeated. When printing is completed, the sheet material 130 is ejected.

Figure 3:
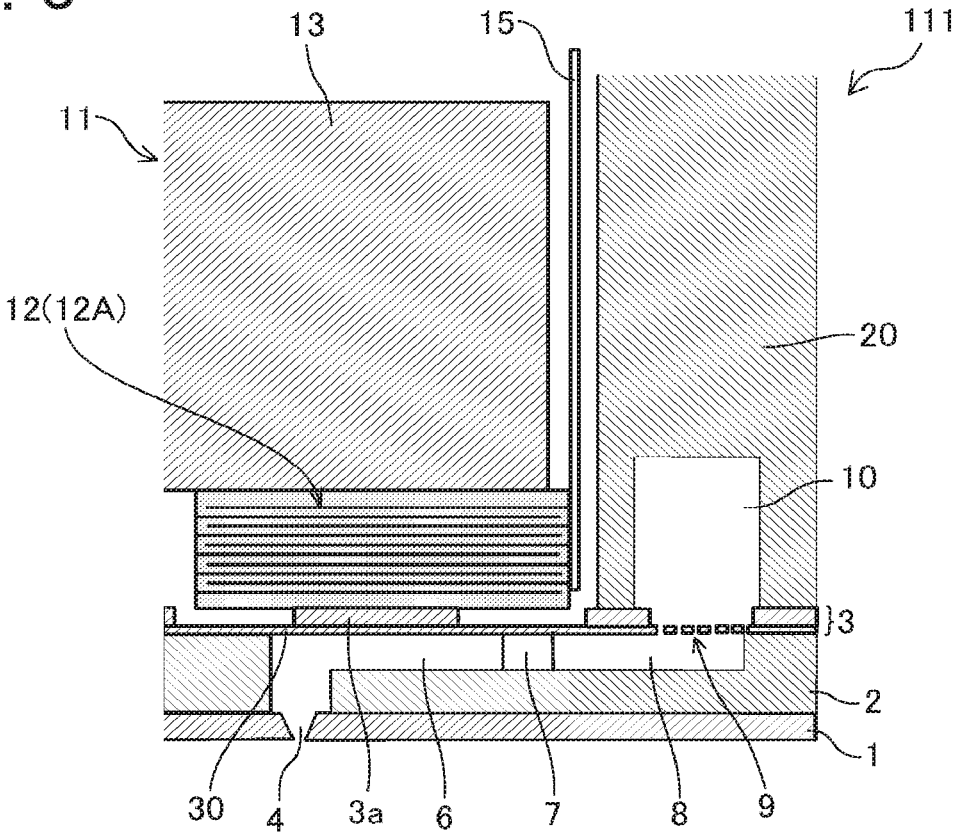
FIG. 3 is an explanatory cross-sectional view of an example of a liquid discharge head, taken along a direction (the longitudinal direction of the liquid chamber) perpendicular to the nozzle array direction.
Figure 4:
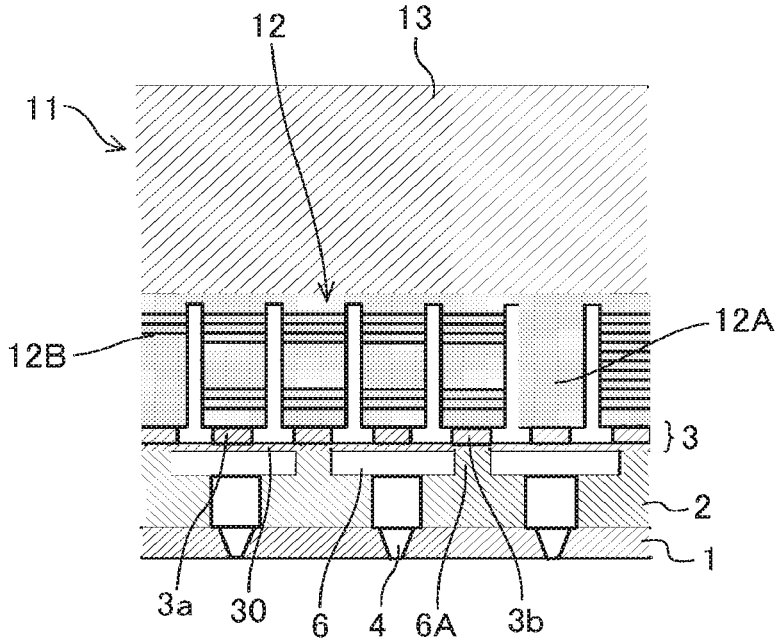
FIG. 4 is an explanatory cross-sectional view of the liquid discharge head, taken along the nozzle array direction (the short-side direction of the liquid chamber)

Referring now to FIGS. 3 and 4, an example of a liquid discharge head is described. FIG. 3 is an explanatory cross-sectional view of the head, taken along a direction (the longitudinal direction of the liquid chamber) perpendicular to the nozzle array direction. FIG. 4 is a cross-sectional explanatory view of the head, taken along the nozzle array direction (the short-side direction of the liquid chamber).

This liquid discharge head 111 joins a nozzle plate 1, a channel plate 2, and a diaphragm member 3. The liquid discharge head 111 includes a piezoelectric actuator 11 that displaces the diaphragm member 3, and a frame member 20 as a common channel member.

These components form individual liquid chambers 6 (also referred to as pressure chambers, pressurizing chambers, or the like) communicating with a plurality of nozzles 4 for discharging liquid droplets, a liquid supply path 7 that supplies liquid to the individual liquid chambers 6 and also serves as a fluid resistance portion, and a liquid introducing portion 8 communicating with the liquid supply path 7. Adjacent individual liquid chambers 6 are separated by partition walls 6A in the nozzle array direction.

From a common channel 10 as the common channel of the frame member 20 through a filter portion 9 formed in the diaphragm member 3, liquid is supplied into the individual liquid chambers 6 via the liquid introducing portion 8 and the liquid supply path 7.

The piezoelectric actuator 11 is disposed on the opposite side of a deformable vibrating region 30 of the diaphragm member 3 from the individual liquid chambers 6. The vibrating region 30 forms wall surfaces of the individual liquid chambers 6.

This piezoelectric actuator 11 includes a plurality of laminated piezoelectric members 12 joined to a base member 13. Grooves are formed in the piezoelectric members 12 by half-cut dicing, so that piezoelectric elements 12A as columnar pressure generating elements that provide drive waveforms, and support columns 12B are formed in a comb-like fashion at predetermined intervals.

The piezoelectric elements 12A are then joined to island-like protruding portions 3*a* formed in the vibrating region 30 of the diaphragm member 3. The support columns 12B are joined to protruding portions 3*b* of the diaphragm member 3.

The piezoelectric member 12 is formed by alternately stacking piezoelectric layers and internal electrodes. The respective internal electrodes are extended onto the end faces, to form external electrodes. A flexible printed circuit (FPC) 15 as a flexible wiring board having flexibility for providing drive waveforms to the external electrodes of the piezoelectric elements 12A is connected to the external electrodes.

In the frame member 20, the common channel 10 into which liquid is supplied from head tanks and liquid cartridges is formed.

In this liquid discharge head 111, the voltage to be applied to the piezoelectric elements 12A is lowered from an intermediate potential Ve, for example, so that the piezoelectric elements 12A contract, and the vibrating region 30 of the diaphragm member 3 descends, to increase the volumes of the individual liquid chambers 6. As a result, liquid flows into the individual liquid chambers 6.

After that, the voltage to be applied to the piezoelectric elements 12A is increased, so that the piezoelectric elements 12A expand in the stacking direction, and the vibrating region 30 of the diaphragm member 3 deforms toward the nozzles 4, to reduce the volumes of the individual liquid chambers 6. As a result, the liquid in the individual liquid chambers 6 is pressurized, and the liquid is discharged (injected) from the nozzles 4.

The voltage to be applied to the piezoelectric elements 12A is then returned to the reference potential. As a result, the vibrating region 30 of the diaphragm member 3 is restored to the initial position, and the individual liquid chambers 6 expand to generate a negative pressure. Thus, the individual liquid chambers 6 are filled with the liquid from the common channel 10 through the liquid supply path 7. In view of this, the operation for the next discharge is started, after the vibration of the meniscus surfaces of the nozzles 4 is attenuated and stabilized.

Figure 5:
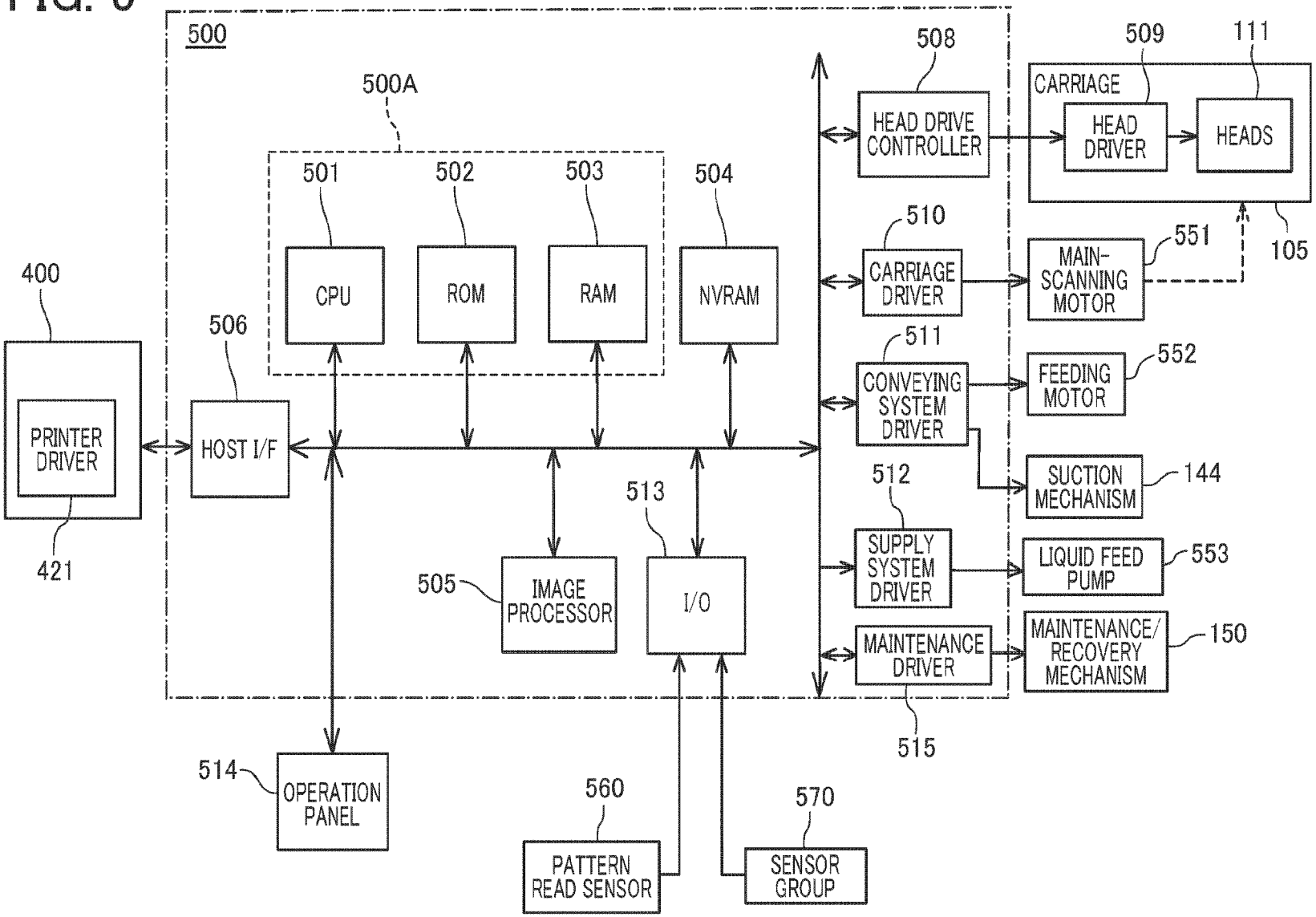
FIG. 5 is an explanatory block diagram of the controller of the liquid discharge apparatus.

Referring now to FIG. 5, the outline of a controller of this printing apparatus is described. FIG. 5 is an explanatory block diagram of the controller.

A controller 500 includes a main controller 500A. The main controller 500A includes: a central processing unit (CPU) 501 that controls the entire apparatus; a read only memory (ROM) 502 that stores fixed data such as various programs including a program to be executed by the CPU 501 to perform a process according to an embodiment of the present disclosure; and a random access memory (RAM) 503 that temporarily stores image data and the like.

The controller 500 also includes: a rewritable nonvolatile memory (non-volatile RAM (NVRAM)) 504 for holding data even when the power supply to the apparatus is off; and an image processor 505 that performs various kinds of signal processing on image data, performs image processing such as rearrangement, and processes input/output signals for controlling the entire apparatus.

The controller 500 also includes a head drive controller 508 including a head controller and a drive waveform generator for controlling the driving of the heads 111. The head drive controller 508 controls the driving of the heads 111 via a head driver (driver integrated circuit (IC)) 509 provided on the side of the carriage 105.

The controller 500 also includes: a carriage driver 510 that drives a main-scanning motor 551 that moves and scans the carriage 105; a feeding motor 552 that drives the conveying roller 141; and a conveying system driver 511 that drives the suction mechanism unit 144.

The controller 500 also includes: a supply system driver 512 that drives a liquid feed pump unit 553 that feeds liquid from the liquid cartridges 120 to the respective heads 111; and a maintenance driver 515 that drives the maintenance/recovery mechanism 150.

The controller 500 further includes an I/O unit 513. The I/O unit 513 acquires a read signal from the read sensor 560 and information from a sensor groups 570 of various sensors, extracts information necessary for controlling the apparatus, and uses the information for various kinds of control.

An operation panel 514 for inputting and displaying information necessary for this apparatus is connected to the controller 500.

The controller 500 also includes an I/F 506 for exchanging data, signals, and the like with a printer driver 591 of a host 590 that is an information processing apparatus such as a personal computer, an image reading device, an imaging apparatus, or the like.

The CPU 501 of the controller 500 reads and analyzes print data in a reception buffer included in the I/F 506, performs necessary image processing, a data rearrangement process, and the like in the image processor 505, and transfers the image data to the head driver 509 via the head drive controller 508.

The head drive controller 508 transfers the image data as serial data, and outputs, to the head driver 509, a transfer clock, a latch signal, a control signal, and the like that are necessary for the transfer of the image data and the confirmation of the transfer.

The head drive controller 508 includes a drive waveform generator that is formed with a D/A converter that performs D/A conversion on the waveform data of a drive waveform read from the ROM 502, a voltage amplifier, a current amplifier, and the like. The head drive controller 508 generates a drive waveform formed with one drive pulse or a plurality of drive pulses, and output the drive pulse(s) to the head driver 509.

The head driver 509 selects a drive pulse forming the drive waveform supplied from the head drive controller 508, in accordance with the image data of one row of the heads 111 that is serially input, and supplies the selected drive pulse to the piezoelectric elements 12A of the heads 111. Thus, the heads 111 are driven. In this case, all or part of the pulses constituting the drive waveform or all or part of the waveform elements constituting the pulse is selected, so that dots of different sizes, such as large droplets, medium droplets, and small droplets, can be printed, for example.

Figure 6:
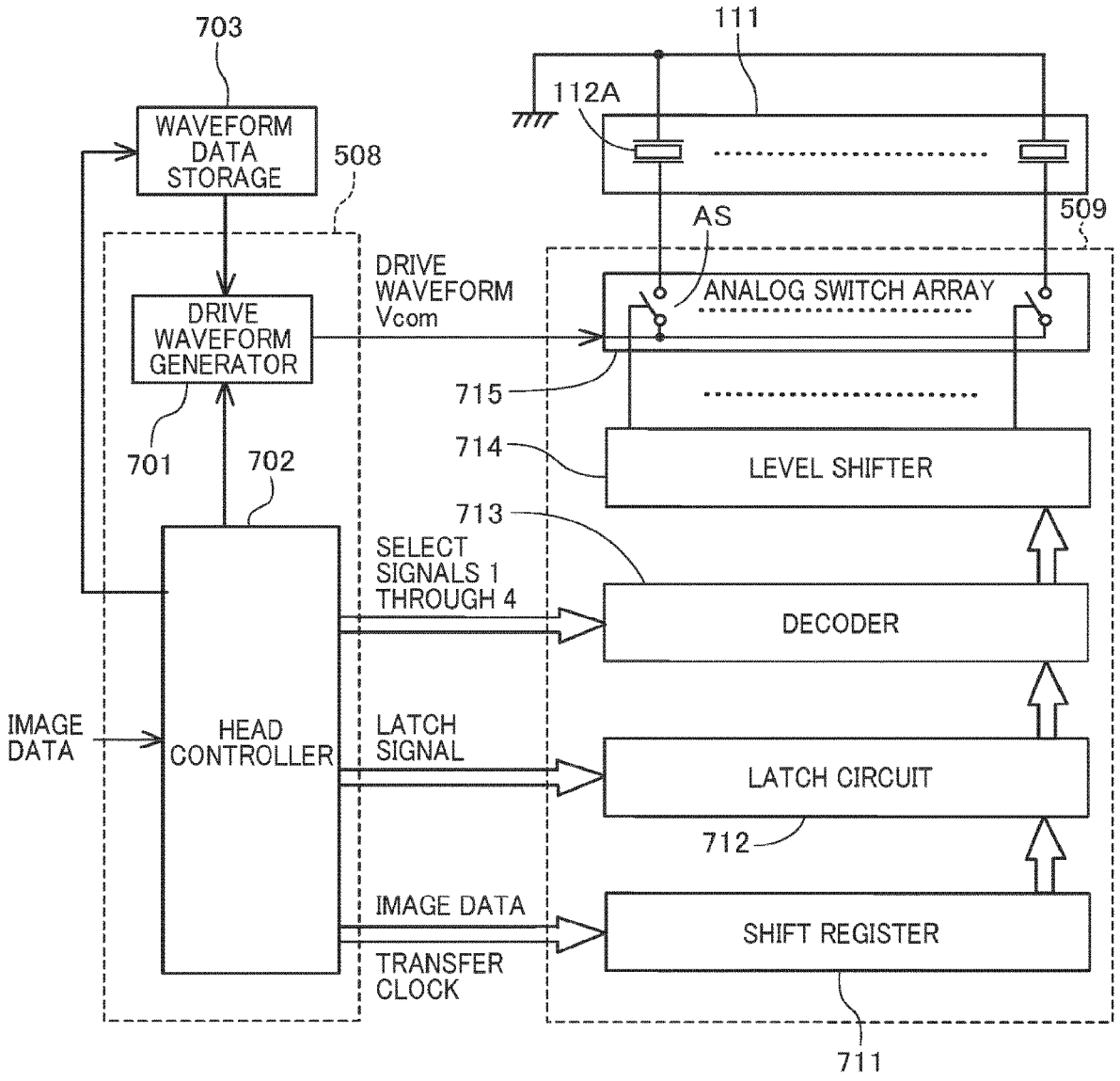
FIG. 6 is an explanatory block diagram of an example of the components relating to head drive control.

Referring now to an explanatory block diagram in FIG. 6, an example of the components relating to the head drive control is described.

The head drive controller 508 includes a drive waveform generator 701. The head drive controller 508 also includes a head controller 702 that outputs 2-bit image data (gradation signals 0 and 1) corresponding to image data, and a select signal (a droplet control signal or a mask signal) for selecting drive pulses forming a clock signal, a latch signal, and a drive waveform.

In this example, the waveform data stored in the ROM 502 is read and given to the drive waveform generator 701 with a signal from the head controller 702 for each drive period, and, within one drive period, a drive waveform Vcom in which a plurality of drive pulses (drive signals) for discharging liquid are arranged in chronological order is generated and output.

Note that the select signal is a signal for instructing an analog switch AS, which is a switching means of the head driver 509, to open or close for each droplet. In synchronization with the drive periods of the drive waveform Vcom, the status of the select signal switches to the H-level (ON) with a drive pulse (or a waveform element) to be selected, and switches to the L-level (OFF) with a drive pulse not to be selected.

The head driver 509 includes a shift register 711, a latch circuit 712, a decoder 713, a level shifter 714, and an analog switch array 715.

The shift register 711 inputs a transfer clock (a shift clock) and serial image data (gradation data: two bits/one channel (one nozzle)) from the head controller 702. The latch circuit 712 latches each register value of the shift register 711 with a latch signal.

The decoder 713 decodes the gradation data and the select signal, and outputs the results. The level shifter 714 converts a logic level voltage signal of the decoder 713 to a level at which the analog switch AS of the analog switch array 715 can operate.

The analog switch AS of the analog switch array 715 is turned on and off (opened and closed) with an output from the decoder 713 supplied via the level shifter 714.

The analog switch AS of the analog switch array 715 is connected to the individual electrodes of piezoelectric elements 112A, and the drive waveform Vcom from the drive waveform generator 701 is input to the analog switch AS. Accordingly, the analog switch AS is turned on in accordance with the results of decoding performed by the decoder 713 on the serially-transferred image data (gradation data) and the select signal by the decoder 713. As a result, the required drive pulses (or waveform elements) constituting the drive waveform Vcom pass (or are selected), and are applied to the individual electrodes of the piezoelectric elements 112A.

Figure 7:
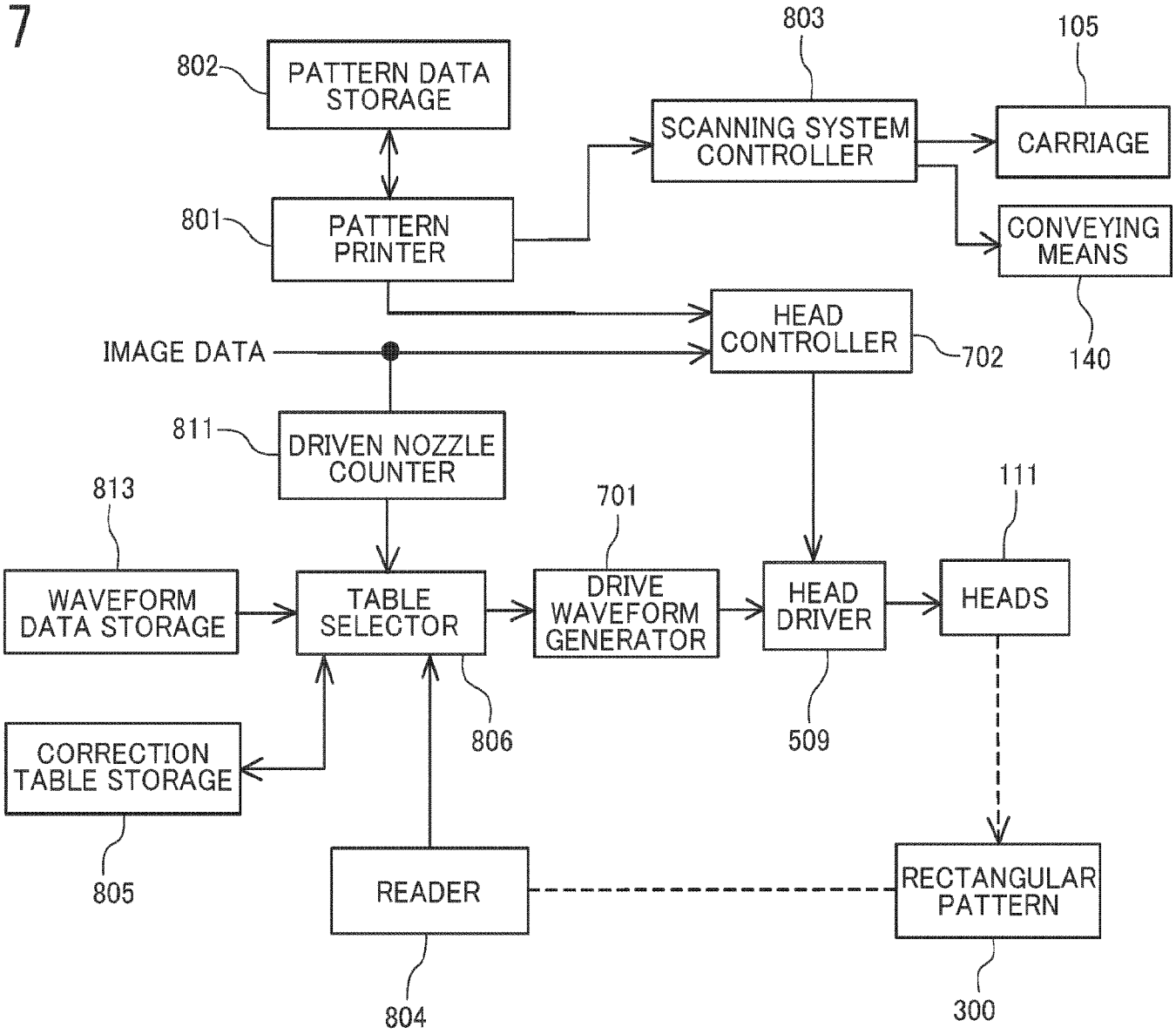
FIG. 7 is an explanatory block diagram of the components relating to pattern printing and generation of a drive waveform according to an embodiment of the present disclosure.

Next, the components relating to pattern printing and generation of a drive waveform according to an embodiment of the present disclosure are described, referring to an explanatory block diagram in FIG. 7.

A pattern printer 801 reads the data of rectangular patterns stored in a pattern data storage 802, and drives the heads 111 via the head controller 702, so that adjacent rectangular patterns 300 are printed under different drive conditions. At this point of time, the pattern printer 801 drives the carriage 105 and the conveying means 140 via a scanning system controller 803.

A reader 804 reads the printed rectangular patterns 300.

A correction table storage 805 stores a plurality of correction tables in which correction magnifications of the drive waveform Vcom are associated with the numbers of nozzles (the numbers of piezoelectric elements) to be driven.

A table selector 806 selects a correction table stored in the correction table storage 805 in accordance with the result of the reading performed by the reader 804 and the result of counting performed by a driven nozzle counter 811, and multiplies drive waveform data read from a waveform data storage 813 by the magnification of the selected correction table.

Before liquid discharge from the heads 111, the driven nozzle counter 811 counts the number of nozzles to discharge liquid (the number of piezoelectric elements 112A to be driven) from the image data.

The waveform data storage 813 stores the waveform data of a reference drive waveform, for example.

Figure 8A:
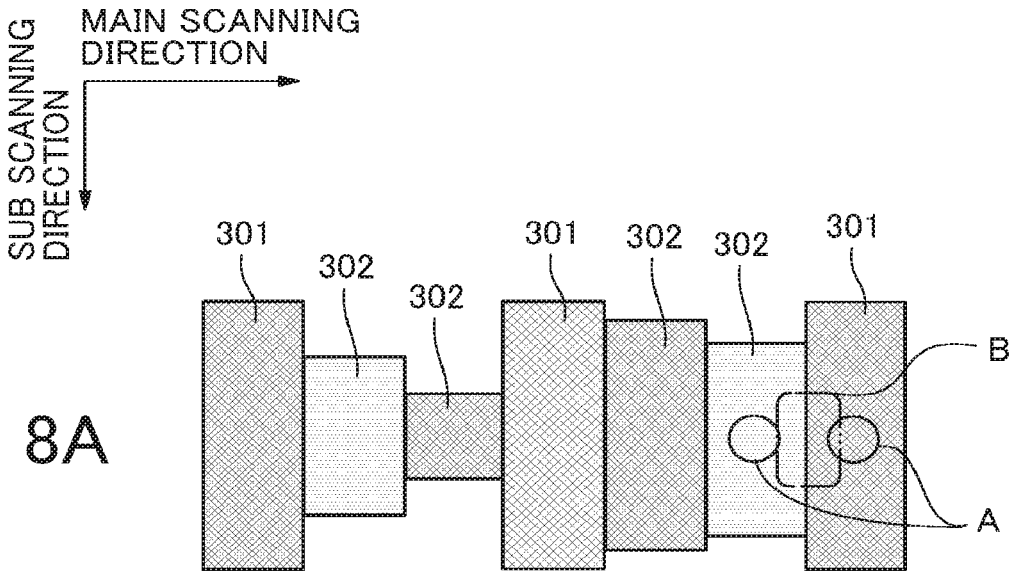
FIGS. 8A through 8C are explanatory diagrams for explaining printing and reading of rectangular patterns according to a first embodiment of the present disclosure.
Figure 8B:
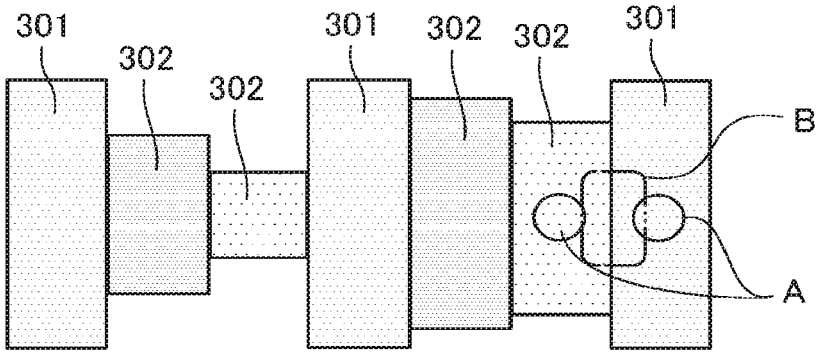
Figure 8C:
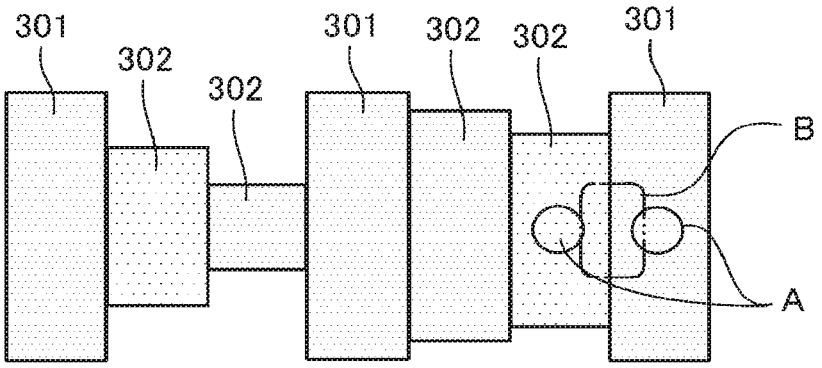

Next, printing and reading of rectangular patterns according to a first embodiment of the present disclosure is described, referring to FIGS. 8A through 8C. FIGS. 8A through 8C are explanatory views for explaining the rectangular pattern printing and reading.

The pattern printer 801 prints reference patterns 301 and adjustment patterns 302 that are adjacent rectangular patterns 300, under different drive conditions. In this example, the reference patterns 301 and the adjustment patterns 302 are printed, while the widths in the sub-scanning direction are changed with the number of driven nozzles as a drive condition.

At this stage, the reference patterns 301 and the adjustment patterns 302 are always adjacent to each other. In this example, a reference pattern 301 is printed at least on one side of each adjustment pattern 302. It is also possible to print reference patterns 301 on both sides of each adjustment pattern 302.

As the reference patterns 301 and the adjustment patterns 302 are arranged so as to be invariably adjacent to each other, it is possible to reduce the influence of repetitive errors in carriage movement and conveyance.

As a result, the rectangular patterns accurately reflect the number of driven nozzles, and correction accuracy becomes higher accordingly.

FIG. 8A illustrates patterns printed with large droplets. FIG. 8B illustrates patterns printed with medium droplets. FIG. 8C illustrates patterns printed with small droplets.

As reference patterns 301 and adjustment patterns 302 are printed with droplets of different sizes, a correction magnification suitable for each droplet size can be set.

Further, consecutive rectangular patterns 300 (reference patterns 301 and adjustment patterns 302) are printed in one color or at least two different colors.

Also, consecutive rectangular patterns 300 (reference patterns 301 and adjustment patterns 302) are printed with nozzles driven by one drive waveform or at least two different drive waveforms.

Further, consecutive rectangular patterns 300 (reference patterns 301 and adjustment patterns 302) are formed with at least two types of droplets of different droplet sizes, including a non-discharge type.

The reference patterns 301 and the adjustment patterns 302 printed in this manner are read with the read sensor 560, and a correction table is selected in accordance with the result of the reading. Note that it is also possible to conduct a visual check, and then input the numerical value of a magnification through the operation panel 514.

The correction table (the correction magnification) corresponding to the number of driven nozzles is selected in the following manner, for example.

The correction table that minimizes the color difference between adjacent rectangular patterns (a reference pattern 301 and an adjustment pattern 302) is selected in accordance with the result of reading of comparative portions A in each of FIGS. 8A through 8C.

The correction table that minimizes the gap and the overlap at the boundary between adjacent rectangular patterns (a reference pattern 301 and an adjustment pattern 302) is selected in accordance with the result of reading of a comparative portion B in each of FIGS. 8A through 8C.

In this case, a surface sensor is used as the read sensor 560 of the reader, and the boundary portions between the adjacent rectangular patterns (reference patterns 301 and adjustment patterns 302) in one screen are imaged. The correction table that minimizes the deviation of colors in one screen is selected in accordance with the result of the imaging.

Figure 9:
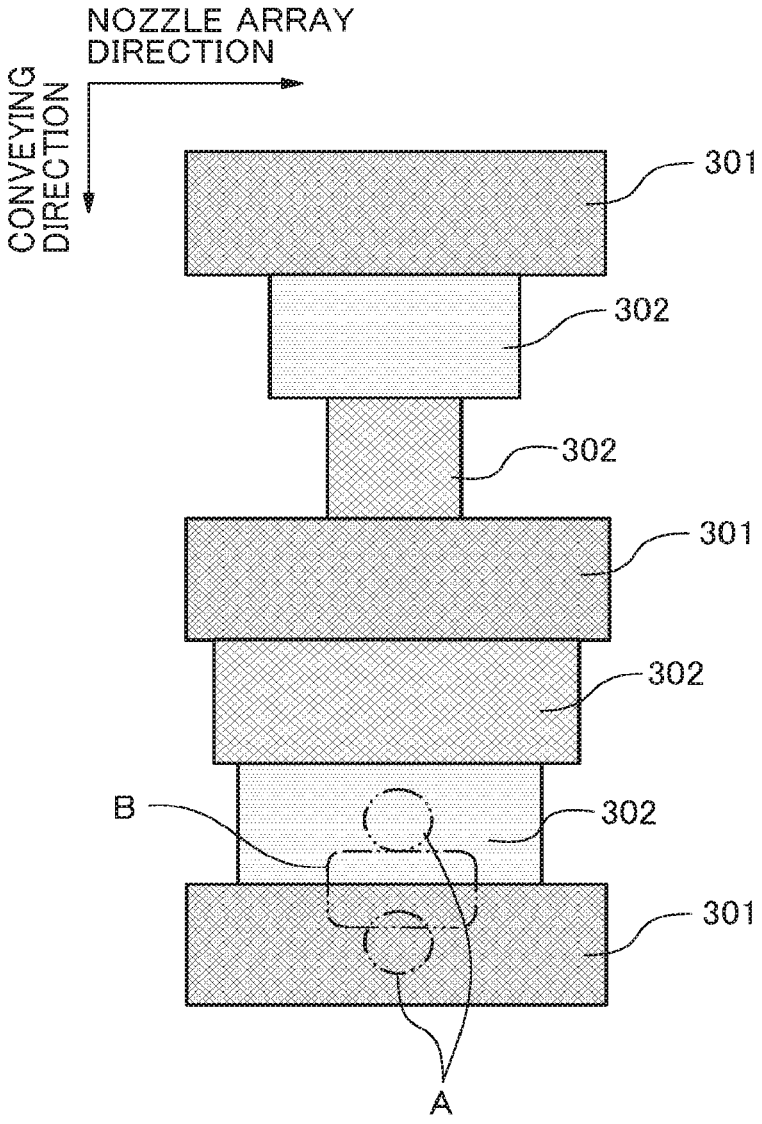
FIG. 9 is an explanatory diagram for explaining printing of rectangular patterns according to a second embodiment of the present disclosure.

Next, printing of rectangular patterns according to a second embodiment of the present disclosure is described, referring to FIG. 9. FIG. 9 is an explanatory view for explaining the rectangular pattern printing.

In this embodiment, rectangular patterns 300 are printed by a line-type apparatus. In this case, the reference patterns 301 and the adjustment patterns 302 are arranged adjacent to each other in the feeding direction.

As described above, the rectangular patterns according to embodiments of the present disclosure can also be used in a line-type apparatus.

Figure 10A:
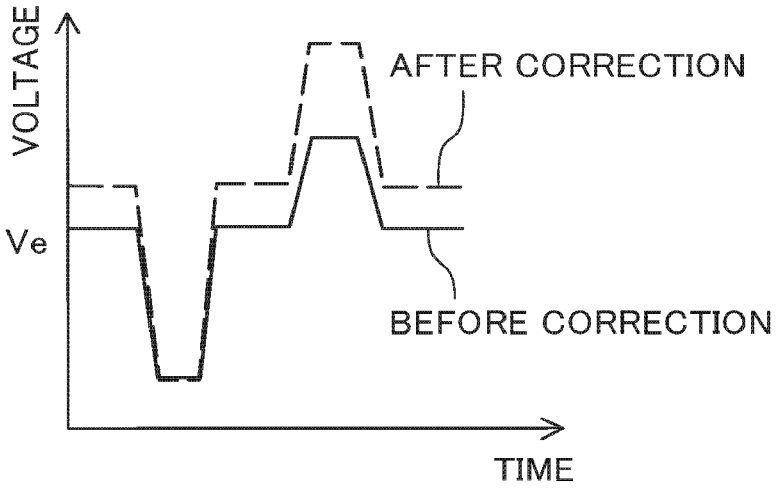
FIGS. 10A and 10B are graphs for explaining a drive waveform correction method.
Figure 10B:
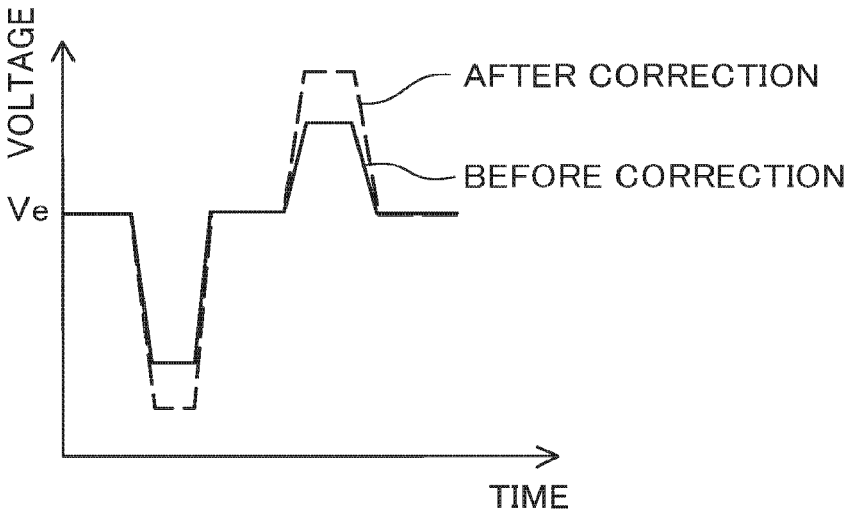

Referring now to FIGS. 10A and 10B, a drive waveform correction method is described. FIGS. 10A and 10B are graphs for explaining examples of an original drive waveform and a drive waveform subjected to magnification correction. FIG. 10A illustrates an embodiment of the present disclosure, and FIG. 10B illustrates Comparative Example 1.

In the correction method of Comparative Example 1, the intermediate potential Ve is the same, and the crest value of each waveform element is changed.

In an embodiment of the present disclosure, on the other hand, correction is performed by multiplying all the elements by a constant magnification.

Because of this correction, there is no need to prepare a different magnification correction table for each element, and accordingly, the correction tables can be made simpler than in Comparative Example 1.

Since the load fluctuation varies with the number of driven nozzles, correction is performed with the optimum correction magnification corresponding to the number of driven nozzles, using a correction table of the correction magnification and the number of nozzles. Further, as a plurality of correction tables is prepared, it is possible to select an optimum correction table for each row in the head (or for each unit of piezoelectric elements connected to the drive power supply).

In each of the above embodiments, a correction table can be selected by a user conducting a visual check when information for selecting the correction table to be used is supplied through the operation panel 514 or the like.

In this application, the liquid to be discharged is not limited to any particular liquid, as long as the liquid has such a viscosity or surface tension that the liquid can be discharged from a head. However, the viscosity of the liquid is preferably not higher than 30 mPa·s under ordinary temperature and ordinary pressure, or by heating or cooling. More specifically, the liquid may be a solution, a suspension, or an emulsion containing a solvent such as water or an organic solvent, a colorant such as a dye or a pigment, a functionalizing material such as a polymerizable compound, a resin, or a surfactant, a biocompatible material such as DNA, amino acid, protein, or calcium, an edible material such as a natural pigment, or the like. Any of these liquids can be used as an inkjet ink, a surface treatment liquid, a liquid for forming components or an electronic circuit resist pattern for electronic elements or light-emitting elements, a three-dimensional modeling material solution, or the like.

Examples of an energy source for generating energy to discharge liquid include a piezoelectric actuator (a laminated piezoelectric element or a thin-film piezoelectric element), a thermal actuator that employs a thermoelectric conversion element such as a heating resistor, and an electrostatic actuator including a diaphragm and opposed electrodes.

A "liquid discharge apparatus" may be an apparatus capable of discharging liquid into air or liquid, instead of an apparatus capable of discharging liquid onto a medium to which liquid can adhere.

This "liquid discharge apparatus" may also include devices relating to feed, conveyance, and discharge of a medium to which liquid can adhere, a preprocessing device, and a post-processing device.

For example, a "liquid discharge apparatus" may be an image forming apparatus that forms an image on a paper sheet by discharging ink, or a stereoscopic modeling apparatus (a three-dimensional modeling apparatus) that discharges a modeling liquid onto a powder layer formed from powder, to model a stereoscopic model (a three-dimensional model).

A "liquid discharge apparatus" is not necessarily an apparatus that discharges liquid to visualize meaningful images, such as characters or figures. For example, a liquid discharge apparatus may form meaningless images such as meaningless patterns, or form three-dimensional images.

The "medium to which liquid can adhere" means a medium to which liquid can at least temporarily adhere, a medium to which liquid adheres and sticks, a medium to which liquid adheres and penetrates, or the like. Specific examples of such media include media onto which recording is performed, such as paper sheets, recording paper, recording sheets, film, and cloth, electronic boards, electronic components such as piezoelectric elements, powder layers (powdery layers), organ models, and test cells. The specific examples include all media to which liquid can adhere, unless otherwise specified.

The material of the above "medium to which liquid can adhere" should be a medium to which liquid can at least temporarily adhere, such as paper, thread, fiber, cloth, leather, metal, plastic, glass, wood, or ceramics.

Alternatively, a "liquid discharge apparatus" may be an apparatus in which a liquid discharge head and a medium to which liquid can adhere move relative to each other, but is not necessarily such an apparatus. Specific examples of such apparatuses include a serial-type apparatus that moves the liquid discharge head, and a line-type apparatus that does not move the liquid discharge head.

Further, a "liquid discharge apparatus" may be a treatment liquid application apparatus that discharges a treatment liquid onto a paper sheet to apply the treatment liquid onto the surface of the paper sheet and modify the surface of the paper sheet, or an injecting granulation apparatus that granulates fine particles of a raw material by spraying a composition liquid containing the raw material dispersed in a solution through a nozzle, or the like.

Note that the terms "image formation", "recording", "printing", "image printing", and "modeling" used herein are all synonymous.

The above-described embodiments are illustrative and do not limit the present disclosure. Thus, numerous additional modifications and variations are possible in light of the above teachings. For example, elements and/or features of different illustrative embodiments may be combined with each other and/or substituted for each other within the scope of the present disclosure.

Any one of the above-described operations may be performed in various other ways, for example, in an order different from the one described above.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA), and conventional circuit components arranged to perform the recited functions.

The invention claimed is:

1. A liquid discharge apparatus, comprising:

a liquid discharge head including a plurality of nozzles to discharge liquid;

a pattern printer to drive the liquid discharge head to print a plurality of adjacent rectangular patterns under different drive conditions, the adjacent rectangular patterns being a reference pattern and an adjustment pattern;

a plurality of correction tables for multiplying a drive waveform to be given to the liquid discharge head by a magnification; and a selector to select a correction table to be used from among the plurality of correction tables.

2. A liquid discharge apparatus, comprising:

a liquid discharge head including a plurality of nozzles to discharge liquid;

a pattern printer to drive the liquid discharge head to print a plurality of adjacent rectangular patterns under different drive conditions, the adjacent rectangular patterns being a reference pattern and an adjustment pattern;

a plurality of correction tables for multiplying a drive waveform to be given to the liquid discharge head by a magnification; and a selector to select a correction table to be used from among the plurality of correction tables, wherein the rectangular patterns are printed with different numbers of the nozzles.

3. The liquid discharge apparatus according to claim 2, wherein the correction table that minimizes a color difference between adjacent ones of the rectangular patterns is selected in accordance with a result of reading of the rectangular patterns.

4. The liquid discharge apparatus according to claim 1, wherein the correction table that minimizes a color difference between adjacent ones of the rectangular patterns is selected in accordance with a result of reading of the rectangular patterns.

5. The liquid discharge apparatus according to claim 4, wherein the correction table that minimizes a gap and an overlap at a boundary between adjacent ones of the rectangular patterns is selected in accordance with a result of reading of the rectangular patterns.

6. The liquid discharge apparatus according to claim 4, wherein the correction table that minimizes deviation of colors within one screen is selected in accordance with a result of imaging of a boundary portion between adjacent ones of the rectangular patterns within the one screen.

7. The liquid discharge apparatus according to claim 4, wherein printing is performed while the rectangular patterns are changed in size depending on the drive conditions.

8. The liquid discharge apparatus according to claim 1, wherein the correction table that minimizes a gap and an overlap at a boundary between adjacent ones of the rectangular patterns is selected in accordance with a result of reading of the rectangular patterns.

9. The liquid discharge apparatus according to claim 1, wherein the correction table that minimizes deviation of colors within one screen is selected in accordance with a result of imaging of a boundary portion between adjacent ones of the rectangular patterns within the one screen.

10. The liquid discharge apparatus according to claim 1, wherein printing is performed while the rectangular patterns are changed in size depending on the drive conditions.

11. The liquid discharge apparatus according to claim 1, wherein one of the rectangular patterns is printed on both sides or one side of another one of the rectangular patterns, the drive condition for the one of the rectangular patterns being different from the drive condition for the another one of the rectangular patterns.

12. The liquid discharge apparatus according to claim 1, wherein consecutive ones of the rectangular patterns are printed in one color or at least two different colors.

13. The liquid discharge apparatus according to claim 1, wherein consecutive ones of the rectangular patterns are printed with nozzles being driven with one drive waveform or at least two different drive waveforms.

14. A liquid discharge apparatus, comprising:

a liquid discharge head including a plurality of nozzles to discharge liquid; and a pattern printer to drive the liquid discharge head to print a plurality of adjacent rectangular patterns under different drive conditions, the adjacent rectangular patterns being a reference pattern and an adjustment pattern, wherein consecutive ones of the rectangular patterns are printed with at least two types of liquid droplets of different droplet sizes, the at least two types including a non-discharge type.

15. The liquid discharge apparatus according to claim 1, wherein consecutive ones of the rectangular patterns are printed with a drive waveform obtained by multiplying a reference drive waveform by a constant magnification, regardless of the number of nozzles to discharge liquid.

16. The liquid discharge apparatus of claim 2, wherein printing is performed while the rectangular patterns are changed in size depending on the drive conditions.

17. The liquid discharge apparatus of claim 2, wherein one of the rectangular patterns is printed on both sides or one side of another one of the rectangular patterns, the drive condition for the one of the rectangular patterns being different from the drive condition for the another one of the rectangular patterns.

18. The liquid discharge apparatus of claim 2, wherein consecutive ones of the rectangular patterns are printed in one color or at least two different colors.

19. The liquid discharge apparatus of claim 2, wherein consecutive ones of the rectangular patterns are printed with nozzles being driven with one drive waveform or at least two different drive waveforms.

20. The liquid discharge apparatus of claim 2, wherein consecutive ones of the rectangular patterns are printed with a drive waveform obtained by multiplying a reference drive waveform by a constant magnification, regardless of the number of nozzles to discharge liquid.

* * * * *